United States Patent [19]

Carminati

[11] Patent Number: 4,738,168

[45] Date of Patent: Apr. 19, 1988

[54] WRENCH

[76] Inventor: Mark J. Carminati, 1929 McKean St., Philadelphia, Pa. 19143

[21] Appl. No.: 895,799

[22] Filed: Aug. 12, 1986

[51] Int. Cl.[4] ..... B25B 13/02

[52] U.S. Cl. ..... 81/125

[58] Field of Search ..... 81/125, 900, 185, DIG. 11

[56] References Cited

U.S. PATENT DOCUMENTS

| | | | |
|---|---|---|---|
| 187,703 | 2/1877 | Bunker . | |
| 1,615,497 | 1/1927 | Woods . | |
| 2,368,902 | 2/1945 | Thompson | 81/125 |
| 2,567,352 | 9/1951 | Rozmus | 81/125 |
| 2,800,822 | 7/1957 | Allred | 81/125 |
| 2,834,240 | 5/1958 | Schlichting | 81/125 |
| 3,165,950 | 1/1965 | Gooley et al. | 81/125 |
| 3,834,253 | 9/1974 | Carr | 81/125 |
| 4,058,032 | 11/1977 | Jacks | 81/125 |

FOREIGN PATENT DOCUMENTS

| | | |
|---|---|---|
| 886095 | 10/1943 | France . |
| 818530 | 8/1959 | United Kingdom . |

*Primary Examiner*—Frederick R. Schmidt
*Assistant Examiner*—Judy J. Hartman
*Attorney, Agent, or Firm*—William H. Murray

[57] ABSTRACT

An improved wrench which retains nuts and bolts for use in areas to which access is difficult or in which there is limited clearance. The wrench includes retaining apparatus for holding a nut or bolt in place, which apparatus is internally located in the closed end of the box wrench. The retaining apparatus is slidingly mounted so it automatically adapts itself to the particular face or side of the wrench being used.

16 Claims, 1 Drawing Sheet

WRENCH

BACKGROUND OF THE INVENTION

This invention relates to wrenches and more particularly to an improved wrench having means for preventing a nut or bolt from being dislodged therefrom.

Existing wrenches include those having closed or box ends configured to receive a nut or bolt head therein. Although this type of wrench is closed around its circumference, it is open in the center in order to enable the nut or bolt head to be inserted into either side. When operating in a confined space, it is sometimes necessary to insert the nut or bolt head into the wrench, lower this combination into the confined space, then attempt to thread the bolt or nut onto its receiving member. Since the existing wrenches are open on both sides, the nut or bolt head inserted therein is precariously retained and, in fact, is frequently dislodged from the wrench when attempting to thread the inserted member onto its receiving member. This not only aggravates the non-professional user but, when encountered by a professional user, such as an auto mechanic, can result in further expense directly attributable to the additional time required to retrieve the nut, if indeed it is impossible to retrieve it, and the reattempts to thread the nut or bolt head onto the appropriate receiving member.

Existing attempts to solve this problem involve external clips or adapters fitted over the end of a wrench for retaining a nut or bolt in place. These devices are cumbersome and may increase the overall dimensions of the wrench thereby exacerbating the problem of utilizing a wrench to install a nut or bolt in an area of limited access. Additionally, the use of a clip or adapter limits the utility of the wrench because the clip or adapter must be moved if the opposite side of the wrench is to be used.

SUMMARY OF THE INVENTION

It is accordingly an object of the present invention to provide an improved wrench that can be used to thread nuts and bolts onto receiving members located in areas of limited access.

It is another object of the present invention to provide an improved box wrench that can retain a nut or bolt in the enclosed box portion of the wrench.

It is a still further object of the present invention to provide an improved wrench which can retain a nut or bolt without any increase in the external dimensions of the wrench.

It is still another object of the present invention to provide an improved wrench that can retain a nut or bolt without interfering with the selective use of either side of the wrench.

It is yet a further object of the present invention to provide an improved wrench capable of retaining a nut which allows the receiving bolt shank to freely extend through the wrench end when the nut is threaded thereon.

This invention obviates the problems with existing wrenches by including retaining apparatus which prevents the nut or bolt head from being pushed through the enclosed portion of the box wrench. The retaining apparatus is located inside the enclosed box end of the wrench so it does not increase the overall dimensions of the wrench. In use, the retaining apparatus slides inside the enclosed box end of the wrench so either side of the wrench can be used to thread nuts or bolts into place.

Additionally, an aperture is provided through the retaining apparatus so the shank of a bolt onto which a retained nut is threaded can extend through the wrench without interference.

The invention features, in one aspect, a wrench including a handle, at least one enclosed box portion attached to the end of the handle, and retaining apparatus for holding a nut or bolt head in the enclosed box portion. The retaining apparatus includes a plurality of projections located adjacent the top and bottom faces of the enclosed box portion. The projections extend from the interior surface of the enclosed box portion towards the center of the box portion. The retaining apparatus also includes a washer, slidingly held in the interior of the enclosed box portion between the projections located adjacent the top and bottom faces of the enclosed box portion.

In preferred embodiments, the invention features a handle offset from the enclosed box portion of the wrench. The enclosed box portion of the wrench is configured to receive either a square or hex shaped nut or bolt head. The enclosed box portion of the wrench includes either a 6-point arrangement or a 12-point arrangement to drive a nut or bolt head. The projections of the retaining apparatus are formed on the interior surface of the enclosed box portion by rolling over portions of the surface. The projections extend approximately 0.003 inches from the interior surface of the enclosed box portion towards the center of the enclosed box portion. The washer of the retaining apparatus has a hexagonal shape with an aperture in the center. The washer has a thickness of approximately 1/16 of an inch.

The invention features, in another aspect, a wrench including a handle, at least one enclosed box portion attached to the end of the handle. A plurality of projections are formed adjacent to the top and bottom faces of the enclosed box portion and on the interior surface of the enclosed box portion by rolling over portions of the surface. A hexagonal washer, having an aperture in the center thereof, is disposed within the enclosed box portion and is retained therein by the aforementioned projections. The hexagonal washer preferably has a thickness not exceeding 1/16 of an inch. The washer is slidingly held in the interior of the enclosed box portion of the wrench between the projections located adjacent to the top and bottom faces of the enclosed box portion so that a nut or bolt head can be held in the enclosed box portion of the wrench for threading into place.

In a further aspect, the invention features a wrench including a handle, and at least one enclosed box portion attached to an end of the handle. A hexagonal washer, having an aperture in the center thereof, is slidingly disposed within the enclosed box portion. Both the wrench and washer are made of a magnetizable material. In one embodiment, the washer is permanently magnetized and retained within the enclosed box portion by the magnetic force exerted on the wrench. In an alternate preferred embodiment, the wrench is permanently magnetized and the washer is retained within the box portion due to the magnetic force exerted thereon by the magnetized wrench. In yet another alternate preferred embodiment, both the wrench and the washer are permanently magnetized and the washer is retained within the enclosed box portion of the wrench due to the mutual attraction of magnetic forces exerted between the magnetized washer and the magnetized wrench.

Other features and advantages of the invention will be apparent from the following detailed description of the preferred embodiments and from the claims.

For a full understanding of the present invention, reference should now be made to the following description and to the accompanying drawings.

DETAILED DESCRIPTION OF THE PREFERRED EMBODIMENTS

Figure 1:
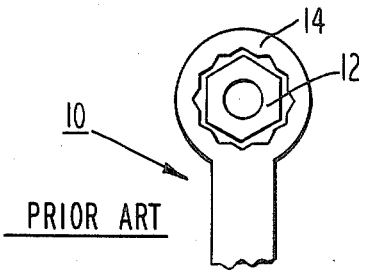
FIG. 1 is a front view of a conventional prior art box wrench with the handle only partially shown and with a standard nut in the enclosed box portion of the wrench.
Figure 2:
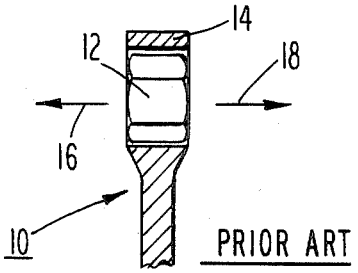
FIG. 2 is a side view, partially cut away, of the prior art wrench shown in FIG. 1.

Referring to FIG. 1, a conventional box wrench, generally designated 10 is shown. The enclosed box portion of the wrench, designated 14, is shown with a typical nut 12 located therein. Referring to FIG. 2, the wrench 10 is shown rotated 90°. As can be seen from FIG. 2 and as will be known to those skilled in the art, the nut 12 can be easily pushed out of the enclosed box portion 14 in either of the directions indicated by arrows 16 and 18 when attempting to thread nut 12 onto a receiving bolt. This also occurs when the user has inserted a bolt head into the enclosed box portion 14 of the wrench 10. This problem is avoided by using a wrench constructed in accordance with the present invention. A preferred embodiment of such a wrench, generally designated 100, is shown in FIGS. 3–6.

Figure 3:
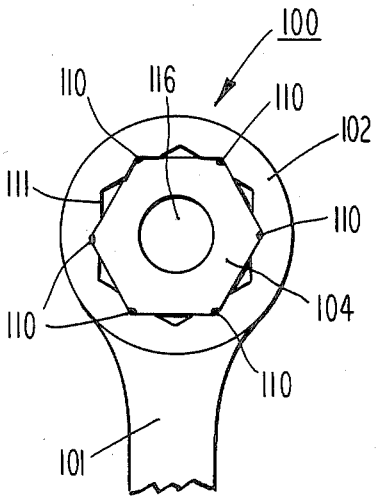
FIG. 3 is a front view of a preferred embodiment of a wrench in accordance with the invention with the handle only partially shown.
Figure 4:
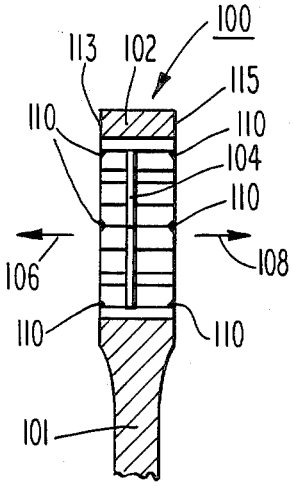
FIG. 4 is a side view, partially cut away, of the wrench shown in FIG. 3.
Figure 5:
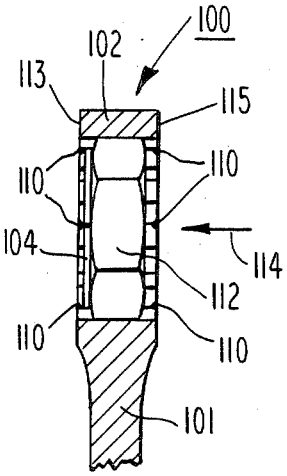
FIG. 5 is a side view, partially cut away, of the wrench shown in FIG. 4 with a conventional nut located in the enclosed box portion of the wrench.
Figure 6:
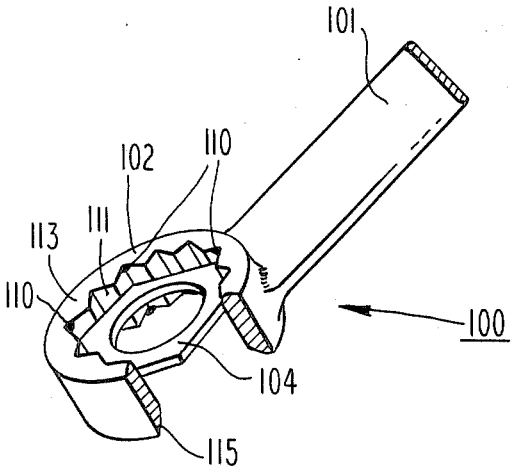
FIG. 6 is a perspective view of the wrench shown in FIG. 3, partially cut away to show the retaining apparatus incorporated in the enclosed box portion of the wrench.

Referring generally to FIGS. 3–6, the wrench 100 includes a handle 101, only partially shown, and an enclosed box portion 102. Box portion 102 is internally configured to receive either square or hex shaped nuts and bolts as is known in the art. Such a configuration may take the form of, for example, a 12-point socket arrangement as shown in FIGS. 3 and 6. Alternatively, a 6-point arrangement, or any other arrangement known in the art for receiving nuts and bolt heads can be used.

A washer 104 is slidingly disposed within the box portion 102 as shown in FIGS. 3 and 6. The washer preferably has an hexagonal shape but it may also be of any other shape which is configured to matingly and slidingly engage the interior region of box portion 102. Washer 104 is free to move within the interior region of box portion 102. Washer 104 is free to move within the interior region of box portion 102 in the directions indicated by arrows 106 and 108 of FIG. 4. Washer 104 is maintained within the interior region of box portion 102 preferably by means of projections 110. It is preferred that the washer have a thickness not exceeding 1/16 inch in order to allow the space required within the box portion to receive and retain a nut or bolt head. The projections 110 extend from the interior surface 111 of box portion 102 towards the center of the enclosure formed by box portion 102. In preferred embodiments, projections 110 are formed by rolling over segments of interior surface 111 of box portion 102 at six points of the box portion which correspond to the six points of hexagonal shaped washer 104. It is preferred that these projections 110 extend approximately 0.003 inches into the interior region of the enclosure formed by box portion 102. This will permit the washer to be maintained within this interior region while allowing wrench 100 to engage a nut or bolt head without interference.

Although it is preferred that there be six projections 110, it should be noted that any number of projections may be used. For example, as few as two projections and as many as twelve projections can be readily employed. A 12-point box end arrangement, utilizing twelve projections, which will cause washer 104 to be maintained within the interior region of enclosed box portion 102, is therefore considered to be within the scope and contemplation of the invention. As can be seen in FIGS. 4–6, projections 110 are formed in proximity to both the top and bottom faces, designated 113 and 115 respectively, of the enclosed box portion 102 of wrench 100, thereby maintaining washer 104 within the interior region of box portion 102.

The operation of the improved wrench will now be described with reference to FIGS. 3–6. A nut 112 (or bolt head as desired) is inserted into the interior region of box portion 102 of wrench 100 as shown in cross-section in FIG. 5. Insertion of nut 112 in the direction shown by arrow 114 causes washer 104 to slide against projections 110. Wrench 100, with nut 112 inserted therein, can now be lowered into the confined space and placed into mating relationship with the receiving bolt without dislodging nut 112 from box portion 102 of wrench 100. The nut is then tightened onto the bolt in conventional fashion. Washer 104 preferably has an aperture 116 in the center thereof (see FIGS. 3 and 6) to permit the receiving bolt to extend therethrough while tightening nut 112.

Figure 7:
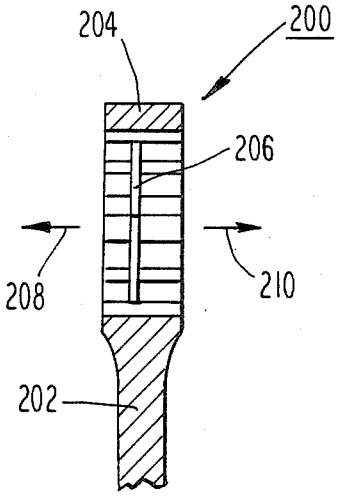
FIG. 7 is a side view, partially cut away, of an alternative preferred embodiment of a wrench in accordance with the present invention.

Referring now to FIG. 7, there is depicted a side view, partially cut away, of an alternate preferred embodiment of a wrench in accordance with the present invention, generally designated 200. The wrench 200 includes a handle 202, only partially shown, and an enclosed box portion 204. Box portion 204 is internally configured to receive either square or hex shaped nut and bolts as is known in the art. Such a configuration may take the form of, for example, a 12 point socket arrangement as shown in FIGS. 3 and 6. Alternatively, a 6 point arrangement, or any other arrangement known in the art for receiving nuts and bolt heads can be used.

A washer 206 is slideably disposed within the box portion 204. The washer preferably has a hexagonal shape but it may also be of any other shape which is configured to matingly and slidingly engage the interior region of box portion 204. Washer 206 is free to move within the interior region of box portion 204 in the directions indicated by the arrows 208 and 210. Washer 206 and at least the box portion 204 of the wrench 200 are made of magnetizable material, such as steel. Either the washer 206 or the box portion 204 or both are permanently magnetized so that the washer 206 is retained within the box portion 204 by magnetic forces. It is preferred that the washer have a thickness not exceeding 1/16 inch in order to allow the space required within the box portion to receive and retain a nut or bolt head.

When a nut (or bolt head as desired) is inserted into the interior region of the box portion 204 of the wrench 200, it will cause the washer 206 to slide toward the opening of the box portion opposite the opening into which the nut or bolt head has been inserted. When the washer reaches the opening, the forces due to the magnetic attraction between the washer 206 and the box portion 204 will prevent the washer from sliding past the end of the box portion 204. As a result, the wrench 200, with the nut (or bolt head) inserted therein, can now be lowered into the confined space and placed into matingly relationship with the receiving bolt (or nut) without dislodging the nut (or bolt head) from the box portion 204 of the wrench 200. The nut (or bolt) is then tightened onto the bolt (or nut) in conventional fashion. The aperture in washer 206 will permit the receiving bolt to extend therethrough while tightening the nut thereon.

As can be seen from the above description with reference to the accompanying figures, the nut or bolt can be inserted from either side of the wrench in order to permit the user to take advantage of any wrench head offset (not shown in the figures). Additionally, although the above description referred to the use of the wrench with nuts, it can be also advantageously used with bolts and such use is, of course, within the scope and contemplation of the invention.

There has been thus been shown and described a novel improved wrench which fulfills all the objects and advantages sought. Many changes, modifications, variations, and other uses and applications of the subject invention, will, however, become apparent to those skilled in the art after considering the specification and the accompanying drawings which disclose preferred embodiments thereof. All such changes, modifications, variations, and other uses and applications within the spirit and scope of the invention are deemed to be covered by the invention which is limited only by the claims which follow.

I claim:

1. A wrench comprising:

(a) a handle having at least one end;

(b) at least one enclosed box portion attached to said at least one handle end, said enclosed box portion having an interior region which is open at each end, said interior region adapted to matingly receive a nut or bolt head through either open end; and (c) retaining means for retaining said nut or bolt head in said enclosed box portion, said retaining means including:

(i) a washer slidingly disposed and free to move within the interior region of said enclosed box portion; and (ii) means for maintaining said washer within the interior of said enclosed box portion.

2. The wrench of claim 1 wherein said means for maintaining said washer within said enclosed box portion comprises a plurality of projections located adjacent top and bottom faces of said enclosed box portion, said projections extending from said enclosed box portion interior surface toward the center of said box portion.

3. The wrench of claim 1 wherein said means for retaining said washer within said enclosed box portion comprises means for exerting a magnetic attraction between a magnetizable box portion and a magnetizable washer.

4. The wrench of claim 2, wherein said handle is offset from said enclosed box portion of said wrench.

5. The wrench of claim 2, wherein said enclosed box portion of said wrench is configured to receive either a square or hex shaped nut or bolt head.

6. The wrench of claim 2, wherein said enclosed box portion of said wrench includes a 6-point arrangement to drive a nut or bolt head.

7. The wrench of claim 2, wherein said enclosed box portion of said wrench includes a 12-point arrangement to drive a nut or bolt head.

8. The wrench of claim 2, wherein said projections of said retaining means are formed on said enclosed box portion interior surface by rolling over portions of said surface.

9. The wrench of claim 8, wherein said projections extend approximately 0.003 inches from said enclosed box portion interior surface towards the center of said enclosed box portion.

10. The wrench of claim 2, wherein said washer of said retaining means has a hexagonal shape.

11. The wrench of claim 2, wherein said washer of said retaining means has a maximum thickness of 1/16 of an inch.

12. The wrench of claim 2, wherein said washer of said retaining means includes a centrally disposed aperture there through.

13. The wrench of claim 3, wherein said means for exerting a magnetic attraction comprises a permanently magnetized washer.

14. The wrench of claim 3, wherein said means for exerting a magnetic attraction comprises a permanently magnetized enclosed box portion.

15. The wrench of claim 3, wherein said means for exerting a magnetic attraction comprises a permanently magnetized enclosed box portion and a permanently magnetized washer.

16. A wrench, comprising:

(a) a handle having at least one end;

(b) at least one enclosed box portion attached to said at least one handle end, said enclosed box portion adapted to matingly receive a nut or bolt head;

(c) a plurality of projections formed adjacent top and bottom faces of said enclosed box portion and on an enclosed box portion interior surface by rolling over portions of said surface, said projections extending from the interior surface of said enclosed box portion approximately 0.003 inches towards the center of said enclosed box portion; and (d) a hexagonal washer having a thickness not exceeding 1/16 of an inch and an aperture in the center thereof, said washer slidingly retained within said enclosed box portion between said projections, whereby said nut or bolt head is retained within said enclosed box portion of said wrench for threading into place.

* * * * *